US005178268A

United States Patent [19]

Talley et al.

[11] Patent Number: 5,178,268

[45] Date of Patent: Jan. 12, 1993

[54] TWO CARTONS RELEASABLY JOINED TO FORM A DUAL CARTON

[75] Inventors: Robert E. Talley, Chester; Edward J. Wooldridge, Richmond, both of Va.

[73] Assignee: Philip Morris Incorporated, New York, N.Y.

[21] Appl. No.: 849,295

[22] Filed: Mar. 10, 1992

Related U.S. Application Data

[63] Continuation-in-part of Ser. No. 774,529, Oct. 8, 1991, Pat. No. 5,141,106.

[51] Int. Cl.[5] ..... B65D 5/00; B65D 85/10; B65B 51/08

[52] U.S. Cl. ..... 206/256; 206/273; 206/813; 229/120.011; 53/416; 53/419; 53/448

[58] Field of Search ..... 206/813, 256, 273; 229/120.011; 53/412, 416, 419, 444, 448, 449

[56] References Cited

U.S. PATENT DOCUMENTS

| | | | |
|---|---|---|---|
| 1,673,426 | 6/1928 | Tinsley | 229/132 |
| 2,109,583 | 3/1938 | Bennett | 206/813 |
| 2,565,509 | 8/1951 | Marcin | 206/813 |
| 2,605,897 | 8/1952 | Rundle | 206/264 |
| 2,697,544 | 12/1954 | Morand | 229/120.04 |
| 2,871,080 | 1/1959 | Shelly | 229/120.01 |
| 2,895,601 | 7/1959 | Krukonis | 206/256 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,113,673 | 12/1963 | Stein | 206/65 |
| 3,144,190 | 8/1964 | Holt et al. | 229/27 |
| 3,160,341 | 12/1964 | Cherney | 206/813 X |
| 3,163,351 | 12/1964 | Borgardt | 206/256 |
| 3,241,738 | 3/1966 | Freiman | 206/813 X |
| 3,322,323 | 5/1967 | Greene et al. | 206/813 X |
| 3,447,733 | 6/1969 | Smith et al. | 206/491 |
| 3,503,568 | 3/1970 | Galley | 242/74 |
| 3,536,246 | 10/1970 | Rosen | 206/256 |
| 3,596,758 | 8/1971 | Phillips, Jr. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,424,658 | 10/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/449 |
| 4,738,359 | 4/1988 | Phillips, Jr. | 206/256 |
| 4,928,817 | 5/1990 | Focke | 206/264 |
| 4,932,534 | 6/1990 | Focke et al. | 206/602 |

*Primary Examiner*—William I. Price

*Attorney, Agent, or Firm*—Jeffrey H. Ingerman; Keren G. Horowitz

[57] ABSTRACT

A dual carton formed from two substantially identical single cartons adhered to one another with adhesive which remains tacky after the cartons are separated. Each carton has a top and tuck-in flap, and the flaps of the two joined cartons are overlapped to seal the dual carton. The tuck-in portion of the flap of one carton is adhered to the top portion of the flap of the other carton with similar adhesive as used to join the cartons. After the cartons are separated, the cartons may be individually sealed by reusing the adhesive on the wall of one carton and on the tuck-in portion of the flap of the other carton to adhere the tuck-in portion of the flaps of the cartons to the outside of the wall opposite the wall from which the flaps extend. The dual carton may be a cigarette carton of dimensions compatible with tax-stamping machinery and temporarily sealed in such a manner as to facilitate the opening and later resealing of the carton for tax-stamping purposes.

31 Claims, 4 Drawing Sheets

FIG. 4
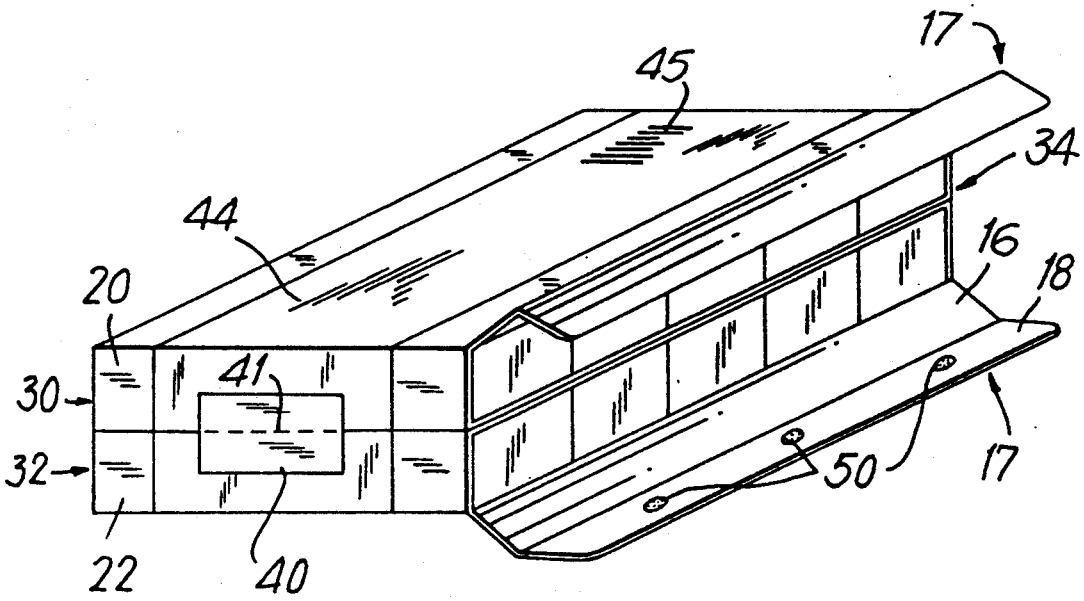
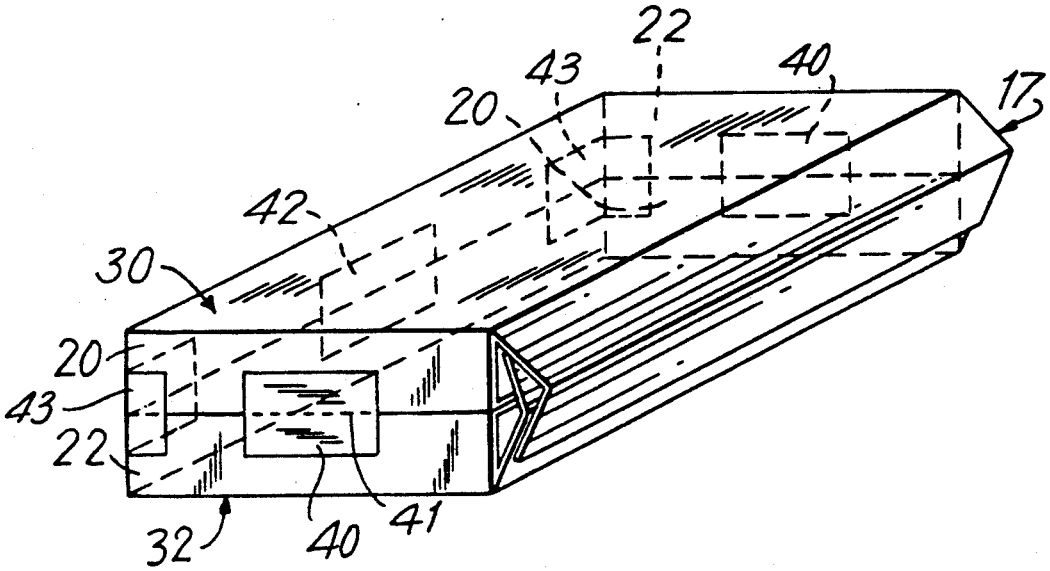
FIG. 5

TWO CARTONS RELEASABLY JOINED TO FORM A DUAL CARTON

CROSS REFERENCE TO RELATED APPLICATION

This application is a continuation-in-part of copending, commonly-assigned U.S. patent application Ser. No. 07/774,529, filed Oct. 8, 1991, now U.S. Pat. No. 5,141,106 which is hereby incorporated by reference in its entirety.

BACKGROUND OF THE INVENTION

The present invention relates to the releasable connection of cartons to form a dual carton, and more particularly to the releasable connection of two separate cigarette cartons to form a dual carton compatible with commercially available tax-stamping machinery.

Cigarette packs (which usually contain twenty cigarettes) are generally rectangular in shape, having front and back long walls connected by two short side walls. Cigarette cartons typically contain two rows of five cigarette packs per row (each row arranged so that the front long walls of the packs are in the same plane and the back long walls are in a parallel plane spaced from the front long walls), and are generally known in the art as ten-pack cartons. Such cigarette cartons are generally filled with cigarette packs by the manufacturer, temporarily closed (e.g., by folding the top flap of the carton over the top of the carton and releasably securing the flap in the closed position), and shipped to various distributors. The distributors generally open the cartons to apply the tax stamp that may be required by the jurisdiction in which they operate to the ends of individual cigarette packs while the packs are still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for ten-pack cartons, i.e., cartons containing two rows of five cigarette packs per row. A typical tax-stamping machine is model FUSON manufactured by Meyercord of 365 East North Avenue, Carol Stream, Ill. 60187.

Single row cigarette cartons which are dimensioned to contain one row of five cigarette packs (each pack usually containing twenty cigarettes, the packs arranged so that the front long walls of the packs are in the same plane and the back long walls are in a parallel plane spaced from the front long walls), i.e., five-pack cartons, are also known in the art. However, although machinery exists for manufacturing such cartons, machinery does not exist for stamping the cigarette packs contained in such cartons. Consequently, such cartons are usually put into scored, glued, and collapsed cartons to be hand-stamped (as is done currently), or would have to be secured together in pairs to be run through the existent tax-stamping equipment in which packs in double row cartons are stamped. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

If two narrow cartons are to be secured together, the means for securement must allow for later separation of the cartons, if desired, by the retailer or consumer. For marketing purposes, once separated, the two cartons should have little or no trace of the means for securement which would disfigure the outward appearance of the cartons. Furthermore, the cartons should be sealed such that they may be opened to apply the required tax stamp and later resealed without disfiguring the outward appearance of the cartons.

SUMMARY OF THE INVENTION

It is therefore an object of this invention to provide means for securing two cartons together to form a dual carton which may be later separated and sealed with the adhesive used for joining the cartons and for sealing the dual carton, for sale of the individual cartons.

It is another object of this invention to provide a means for securing cartons together for passing through tax-stamping machinery, such that the cartons are not sheared apart by the vertical rollers of the tax-stamping machines which roll along the vertical walls of the cartons to transfer the cartons between the various stages of the process, and such that a tax stamp may be properly registered on the packs.

It is yet another object of this invention to join two cartons together to form a dual carton which outwardly resembles an individual carton.

It is a further object of this invention to provide a means for making a clean separation between the individual cartons if desired for sale as an individual carton instead of as a multiple unit carton.

These and other objects of the invention are accomplished in accordance with the principles of the invention by joining two cartons together along the tops of abutting walls with adhesive which remains tacky after the cartons are separated and remains adhered to one of the cartons. The cartons have top and tuck-in flaps which are overlapped and joined with similar adhesive applied to the tuck-in portion of the flap of the other of the cartons to seal the cartons in the dual carton configuration. Once the cartons are separated, the adhesive along the top of the wall of the first-mentioned carton is used to seal the first carton, and the adhesive on the tuck-in portion of the flap of the second-mentioned carton is used to seal the second carton.

BRIEF DESCRIPTION OF THE DRAWINGS

Further features of the invention, its nature, and various advantages will be more apparent from the following detailed description of the preferred embodiments and the accompanying drawings wherein like reference characters represent like elements throughout, and in which:

FIG. 4 is an isometric view of two five-pack cartons containing cigarette packs, and connected in accordance with this invention; and FIG. 5 is an isometric view of two five-pack cartons connected in accordance with this invention and with their top flaps overlapped.

DETAILED DESCRIPTION OF THE INVENTION

Figure 1:
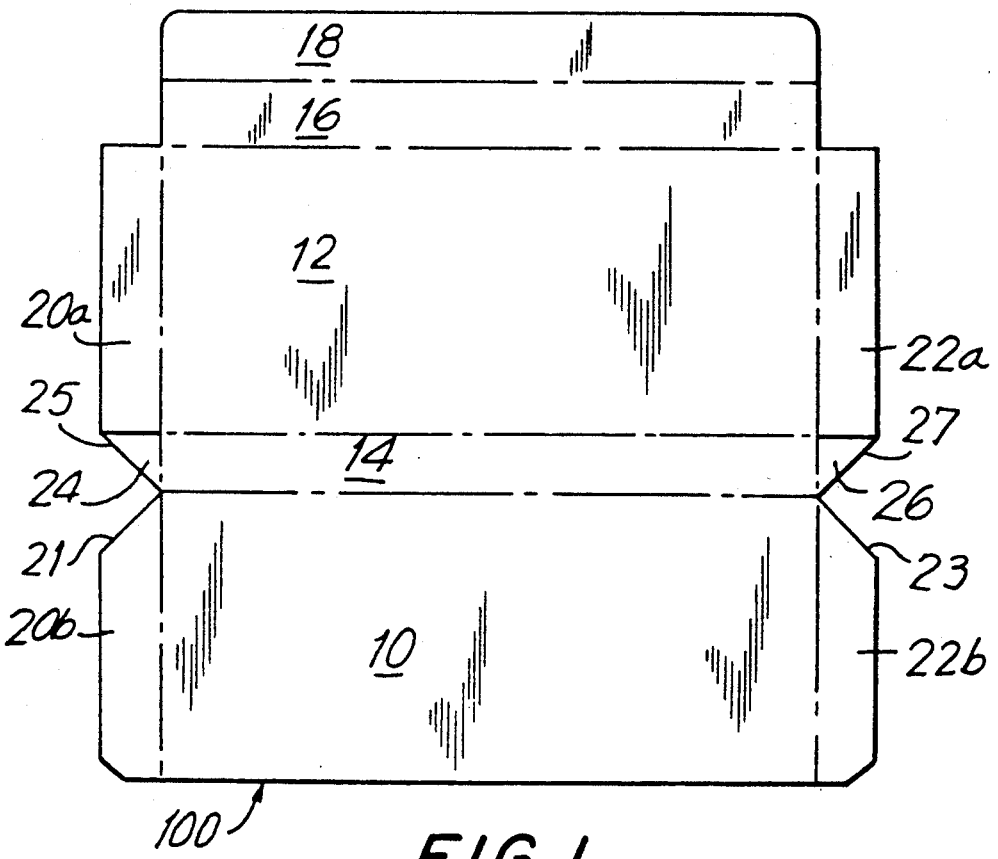
FIG. 1 is a plan view of an illustrative carton blank for a carton in accordance with this invention.

Blank 100, shown in FIG. 1, is an illustrative blank for forming cartons in accordance with this invention. Blank 100 is preferably formed from a substantially stiff material such as cardboard or paperboard, and has a front panel 10, a rear panel 12, and a bottom panel 14, which are each folded along fold lines shown as broken lines not individually labeled, to form a carton. Top flap/extension panel 16 forms the top wall, and tuck-in flap/extension panel 18 is preferably releasably secured to the exterior of the carton, on the outside of wall 10. Tuck-in flap 18 may also be tucked into the filled carton formed from blank 100, between the cigarette packs and wall 10. Preferably top flap 16 extends the entire distance between panels 10 and 12 when blank 100 is folded into a carton. Tuck-in flap 18 preferably is the same dimension as top flap 16, for reasons as will be explained below. Dust flaps 24 and 26 are folded preferably perpendicular to bottom wall 14. Panels **20*b* and 22*b* are then folded adjacent dust flaps 24 and 26, respectively, and substantially perpendicular to panel 12. Preferably dust flaps 24 and 26 include cut edges 25 and 27, respectively, and panels 20*b* and 22*b* include cut edges 21 and 23, respectively. When included, edge 21 aligns with edge 25 and edge 23 aligns with edge 27 so that panel 20*b* lies in the same plane as dust flap 24, and panel 22*b* lies in the same plane as dust flap 26. Panels 20*a* and 22*a* are folded over panels 20*b* and 22*b*, respectively, to complete side wall 20, formed by panels 20*a* and 20*b*, and side wall 22, formed by panels 22*a* and 22*b***.

Figure 2:
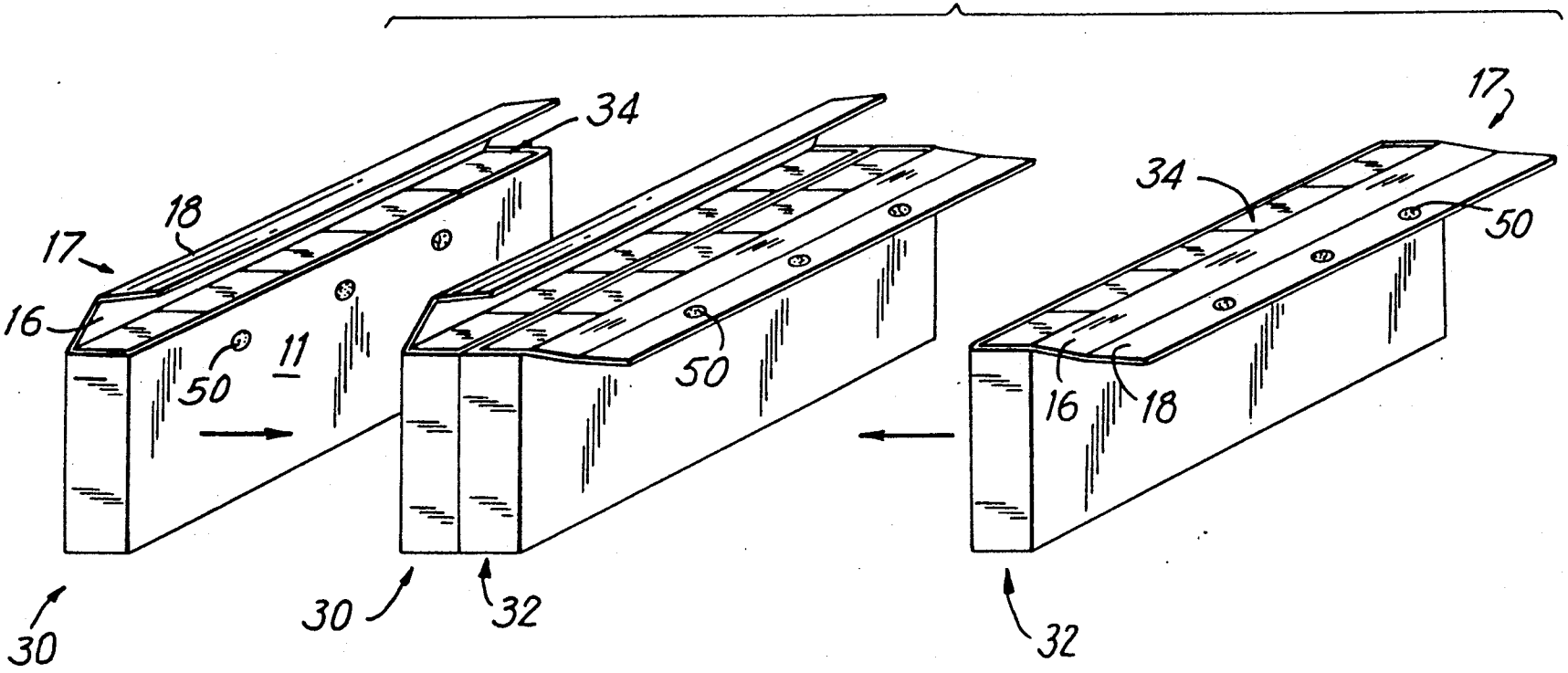
FIG. 2 is an exploded isometric view of two separate five-pack cartons, each constructed from a blank similar to that of FIG. 1, being joined to form ten-pack dual carton.

The connection of two five-pack cartons 30, 32, each formed from a blank similar to blank 100, is shown in FIG. 2. Cartons 30, 32 are joined along front walls 10, hereinafter referred to, in connection with the dual carton, as interior walls 11, with adhesive dots 50 to form a dual carton. Preferably only one carton, here carton 30, has adhesive 50 applied to interior wall 11, while the other carton, here carton 32, has adhesive dots 50 applied to tuck-in flap 18. Once connected, the cartons are sealed by folding panel 16 of carton 30 over carton 30, panel 18 of carton 30 over carton 32, panel 16 of carton 32 over panel 18 of carton 30, and panel 18 of carton 32 over panel 16 of carton 30. Adhesive 50 joins panel 18 of carton 32 to panel 16 of carton 30 to thereby seal the dual carton. Adhesive 50 is any adhesive known in the art which remains tacky even after the surfaces which the adhesive bonds together are separated. Hence, after cartons 30, 32 are separated for individual sale, carton 30 may be sealed by adhering flap 18 of carton 30 to wall 11 of carton 30 with adhesive 50 left on wall 11. Carton 32 likewise may be sealed by adhering flap 18 of carton 32 to wall 11 of carton 32 with adhesive 50 left on flap 18. The type and method of application of adhesive 50, and the preparation of the surfaces of wall 11 and flap 18 to which adhesive 50 is applied are selected to control the desired transfer, release, and adherence of adhesive 50.

Figure 3:
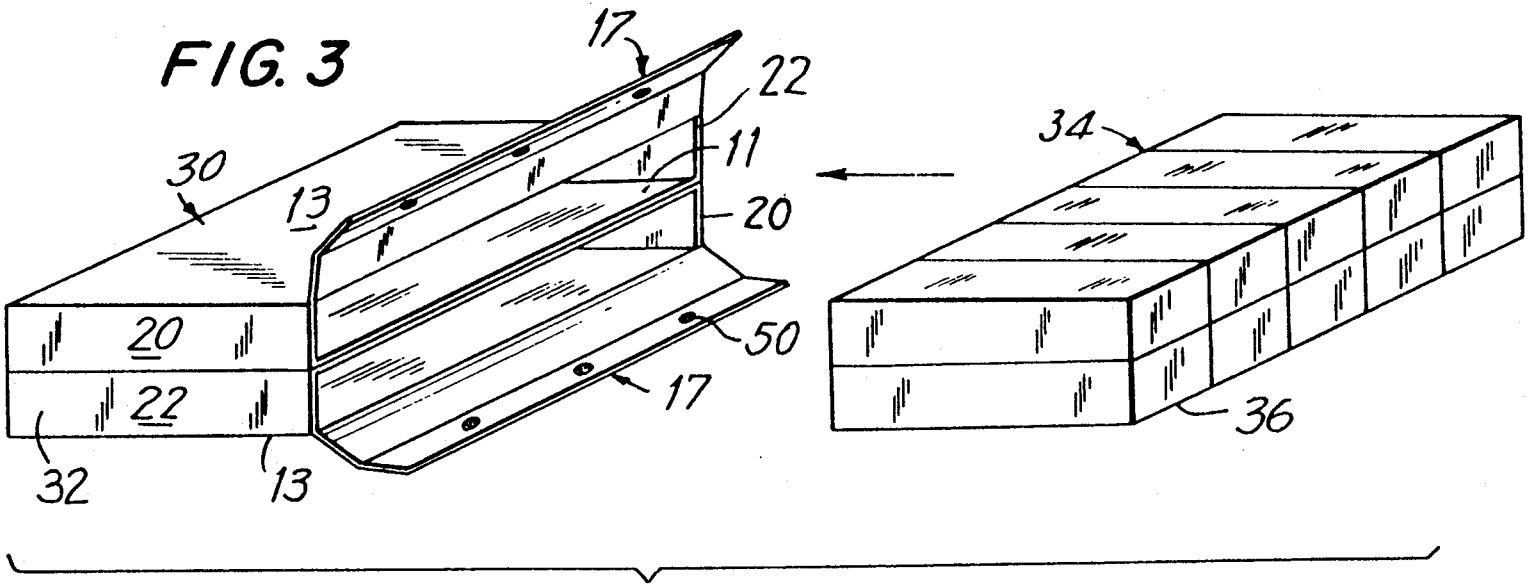
FIG. 3 is an exploded isometric view of two five-pack cartons, each constructed from a blank similar to that of FIG. 1, connected together in accordance with this invention to form a ten-pack carton, as illustrated prior to insertion of cigarette packs into the carton.

Although the five-pack cartons of FIG. 2 are shown filled with bundles of cigarette packs 34 before being joined along walls 11, cartons 30, 32 may be joined and later filled with bundle 34, as shown in FIG. 3. When the cartons are filled in the dual carton configuration, packs 36 are arranged in a bundle 34 of two rows of five packs per row. The cartons are shown joined along interior walls 11, with flaps 17, formed from panels 16 and 18, open, prepared for insertion of bundle 34. Rear walls 12 remain visible after connection of cartons 30, 32, and are hereinafter referred to as exterior walls 13. Because "a" panels **20*a* and 22*a* are preferably folded over "b" panels 20*b* and 22*b*, the free edges of each of the "a" panels of the side walls faces inwardly, i.e., the free edges lie adjacent interior walls 11, when cartons 30, 32** are joined. In this configuration, the free edges of the "a" panels are not readily accessible and thus are relatively safe from being accidentally lifted from their place adjacent the "b" panels.

Packs 36 are preferably arranged in two rows of five packs per row with the short walls of adjacent packs facing each other and the long walls of the packs arranged in parallel planes such that the front walls of each row are in a first single plane and the rear walls of each row are in a second single plane spaced from and parallel to the first single plane. Furthermore, it is desirable to place packs 36 in their respective cartons such that their front walls (defined by the orientation of printed matter on the exterior surface of the walls) face interior walls 11 of cartons 30, 32.

Although adhesive 50 preferably sufficiently joins cartons 30, 32, additional securing means such as band of material 44, or carrier means bearing adhesive such as labels 40, 42, or 43, may be used, as well. Band 44 may be formed of either transparent or opaque material such as plastic or paper. Cartons 30, 32 are shown in FIGS. 4 and 5 joined along interior walls 11 with adhesive 50 (shown in FIG. 2), and further joined along side walls 20 and 22 with labels 40, 42, and 43, and band 44. Label 40 is positioned across side walls 20 and 22 of cartons 30 and 32. Labels 42 and 43 are shown in FIG. 5, positioned across the bottom walls and corners, respectively, of the cartons. Label 40 preferably includes a line of weakness such as perforated line 41, positioned substantially above and parallel to the walls across which label 40 is placed, to facilitate later separation of cartons 30, 32 along line 41. Such lines of weakness may also be provided along labels 42 and 43, and positioned as line 41 is.

Label 40 or 42 may optionally bear pricing indicia such as Universal Product Code (U.P.C.) indicia for the automatic pricing of the dual carton, such as described in co-pending, commonly assigned U.S. patent application Ser. No. 07/792,617, filed Nov. 15, 1991, which is hereby incorporated by reference in its entirety. The indicia are preferably positioned such that they are rendered unreadable by automatic scanning equipment upon separating the cartons so that a consumer is not charged the price of a dual carton for a single carton. Such labels may be applied across any adjacent coplanar walls of cartons 30, 32. Preferably, if pricing indicia are included, only one label bearing pricing indicia is used. Alternatively, indicia for the automatic pricing of the dual carton such as indicia 45, may be printed on band 44. Pricing indicia for the individual cartons are preferably printed on interior walls 11, and are only accessible to automatic scanning equipment when cartons 30, 32 are separated.

The joined cartons are filled with cigarette bundle 34 and are ready for temporary closing with adhesive 50. Because adhesive 50 is applied along the inner side of flap 18 of carton 32 in FIG. 3, the interior wall 10 bearing adhesive 50 along its upper end is wall 10 of carton 30 (not shown).

Top flaps 17 of joined cartons 30 and 32 are shown overlapped in FIG. 5. In this embodiment, tuck-in flap 18 of carton 30 bears adhesive 50 and is positioned over and releasably secured to top flap 16 of carton 32. Thus, the upper end of wall 10 of carton 32 (not shown) bears adhesive 50 for joining the cartons. Cartons 30, 32 are joined as shown in FIG. 5 before tax-stamping. If desired, cartons 30, 32 may be similarly joined after tax-stamping for sale as a dual carton. Alternatively, the cartons may be separated for individual sale. In this case, the tuck-in flap bearing adhesive is either secured to the exterior of the carton or tucked inside. The tuck-in flap not bearing adhesive is secured to adhesive remaining on the formerly interior wall.

Although dots of adhesive are shown, adhesive may be applied in lines or any other convenient pattern, in quantities sufficient to join or seal the cartons.

Although cartons 30, 32 are described as each dimensioned to hold one row of five cigarette packs, they may lengthened or shortened to hold more or fewer than five packs. Furthermore, it will be appreciated that these concepts may be applied to the connection of cartons of other configurations for which distributors commonly have tax-stamping machinery.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be appreciated that the directional references "top," "bottom," "front," and "rear" do not limit the respective panels to such orientation, but merely serve to distinguish these panels from one another.

It will be understood that the foregoing is merely illustrative of the principles of the invention, and that various modification can be made by those skilled in the art without departing from the scope and spirit of the invention. For example, such connection of cartons may be applied to any cartons, and is not limited to cigarette cartons. The described embodiments are presented for the purpose of illustration rather than limitation, and the present invention is limited only by the claims which follow.

What is claimed is:

1. A dual carton comprising:

a first carton having first and second ends; a first pair of first and second opposed walls having a first edge adjacent said first end and a second edge adjacent said second end; a second pair of third and fourth opposed walls having a first edge adjacent said first end and a second edge adjacent said second end; a first extension panel extending from said first edge of said first wall and having a distal edge; and a second extension panel extending from said distal edge of said first extension panel; and a second carton substantially identical to said first carton and having first and second ends; a first pair of first and second opposed walls having a first edge adjacent said first end and a second edge adjacent said second end; a second pair of third and fourth opposed walls having a first edge adjacent said first end and a second edge adjacent said second end; a first extension panel extending from said first edge of said first wall and having a distal edge; and a second extension panel extending from said distal edge of said first extension panel; wherein:

said first and second cartons are positioned adjacent one another with said second wall of said first carton adjacent and coextensive with said second wall of said second carton such that the borders of said coextensive walls are aligned to form said dual carton;

said second walls of said first and second cartons are joined with adhesive; and when said extension panels of said first and second cartons are overlapped to seal said cartons, said dual carton outwardly resembles a single carton.

2. The dual carton of claim 1 further including adhesive on the side of said second extension panel of one of said first and second cartons which faces said carton when said extension panel is folded toward said second wall such that said adhesive joins said extension panels of said first and second cartons when said panels are overlapped.

3. The dual carton of claim 2 wherein said adhesive on said second extension panel and said adhesive joining said first and second cartons are releasable adhesive which remains tacky after the surfaces which the adhesive joins are pulled apart so that said adhesive is reusable.

4. The dual carton of claim 2 wherein:

said adhesive joining said first and second cartons is located on said second wall of said first carton adjacent said first end;

said adhesive on said second extension panel is located on said second extension panel of said second carton;

said first and second cartons are sealed in said dual carton configuration by folding said first extension panel of said first carton over said first carton, folding said second extension panel of said first carton over said second carton, folding said first extension panel of said second carton over said second carton and over said second extension panel of said first carton, folding said second extension panel of said second carton over said first carton, and securing said second extension panel of said second carton over and to said first extension panel of said first carton; and when said first and second cartons are separated, said first carton is capable of being sealed by adhering said second extension flap of said first carton to said adhesive on said second wall, and said second carton is capable of being sealed by adhering said second extension flap of said second carton to said second wall of said second carton with said adhesive on said second extension flap of said second carton.

5. The dual carton of claim 1 wherein:

said distal edge of said first extension panel of said first carton lies adjacent said first edge of said second wall when said first extension panel of said first carton is folded substantially perpendicular to said first wall and toward said second wall; and said distal edge of said first extension panel of said second carton lies adjacent said first edge of said second wall when said first extension panel of said second carton is folded substantially perpendicular to said first wall and toward said second wall.

6. The dual carton of claim 5 wherein:

said second extension panel of said first carton is substantially the same dimension as said first extension panel of said first carton; and said second extension panel of said second carton is substantially the sam dimension as said first extension panel of said second carton.

7. The dual carton of claim 6 further including adhesive on said second extension panel of one of said first and second cartons, on the side of said panel which faces said carton when said panel is folded toward said second wall, such that said extension panels of said first and second cartons are capable of being overlapped and joined to one another with said adhesive; wherein said second extension panel bearing said adhesive lies above and is coextensive with said first extension panel of the other of said first and second cartons so that said first and second cartons, when so joined, resemble a single unit.

8. The dual carton of claim 1 wherein:

said first carton has a bottom wall extending at least from said second edge of said first wall to said second edge of said second wall of said first carton; and said second carton has a bottom wall extending at least from said second edge of said first wall to said second edge of said second wall of said second carton.

9. The dual carton of claim 1 wherein:

said first and second cartons each comprise a cigarette carton for packaging a first number of cigarette packs in each said carton, each said pack having a pair of front and rear long walls and a pair of opposed short walls;

the widths of said first and second walls of said first and second cartons are at least as wide as a second number of times the width of the long wall of said cigarette pack;

the widths of said third and fourth walls of said first and second cartons are at least as wide as a third number of times the width of the short wall of said cigarette pack; and said first number of cigarette packs, equal to the product of said second number of times the width of the long wall of said cigarette pack and said third number of times the width of the short wall of said cigarette pack, can be positioned inside each of said first and second cartons with said short walls of said packs parallel said third and fourth walls of said cartons, such that said dual carton contains twice said first number of cigarette packs and has dimensions compatible with commercially available tax-stamping equipment.

10. The dual carton of claim 9 wherein said second number of times the width of the long wall of said cigarette pack is five.

11. The dual carton of claim 10 wherein said third number of times the width of the short wall of said cigarette pack is one.

12. The dual carton of claim 9 wherein said third number of times the width of the short wall of said cigarette pack is one.

13. The dual carton of claim 1 further including carrier means bearing adhesive positioned across adjacent coplanar walls of said first and second cartons with said adhesive bearing side in operative contact with said last mentioned walls.

14. The dual carton of claim 1 further including a band of material placed around said first and second cartons.

15. The dual carton of claim 14 wherein said material is transparent.

16. The dual carton of claim 14 wherein said material is opaque.

17. The dual carton of claim 14 wherein pricing indicia for the automatic pricing of the dual carton are printed on said band of material.

18. A method for securing two cartons together to form a dual carton which may be separated later, said method comprising the steps of:

providing a first carton having first and second ends; a first pair of first and second opposed walls each having a first edge adjacent said first end and a second edge adjacent said second end; a second pair of third and fourth opposed walls each having a first edge adjacent said first end and a second edge adjacent said second end; a first extension panel extending from said first edge of said first wall and having a distal edge; and a second extension panel extending from said distal edge of said first extension panel;

providing a second carton substantially identical to said first carton and having first and second ends; a first pair of first and second opposed walls each having a first edge adjacent said first end and a second edge adjacent said second end; a second pair of third and fourth opposed walls each having a first edge adjacent said first end and a second edge adjacent said second end; a first extension panel extending from said first edge of said first wall and having a distal edge; and a second extension panel extending from said distal edge of said first extension panel;

applying adhesive to said second wall of one of said first and second cartons;

positioning said first and second cartons adjacent one another with said second wall of said first carton adjacent and coextensive with said second wall of said second carton such that the borders of said coextensive walls are aligned to form said dual carton;

joining said first and second cartons with said adhesive; and overlapping said extension panels of said first and second cartons to seal said cartons such that said dual carton outwardly resembles a single carton.

19. The method of claim 18 further including the step of applying adhesive on the side of said second extension panel of one of said first and second cartons which faces said carton when said panel is folded toward said second wall, for joining said extension panels of said first and second cartons to one another.

20. The method of claim 19 wherein:

said adhesive on said second extension panel and said adhesive joining said first and second cartons are releasable adhesive which remains tacky after the surfaces which the adhesive joins are pulled apart so that said adhesive is reusable;

said step of applying adhesive to said second wall includes the step of applying adhesive to said second wall of said first carton adjacent said first end;

said step of applying adhesive to said second extension panel includes the step of applying adhesive to said second extension panel of said second carton; and said step of overlapping said extension panels of said first and second cartons further includes the steps of folding said first extension panel of said first carton over said first carton, folding said second extension panel of said first carton over said second carton, folding said first extension panel of said second carton over said second carton and over said second extension panel of said first carton, folding said second extension panel of said second carton over said first carton, and securing said second extension panel of said second carton over and to said first extension panel of said first carton.

21. The method of claim 20 further including the steps of:

separating said first and second cartons;

adhering said second extension flap of said first carton to said adhesive on said second wall of said first carton to seal said first carton; and adhering said second extension flap of said second carton to said second wall of said second carton with said adhesive on said second extension flap of said second carton to seal said second carton.

22. The method of claim 20 wherein:

said distal edge of said first extension panel of said first carton lies adjacent said first edge of said second wall when said first extension panel of said first carton is folded substantially perpendicular to said first wall and toward said second wall;

said second extension panel of said first carton is substantially the same dimension as said first extension panel of said first carton;

said distal edge of said first extension panel of said second carton lies adjacent said first edge of said second wall when said first extension panel of said second carton is folded substantially perpendicular to said first wall and toward said second wall;

said second extension panel of said second carton is substantially the same dimension as said first extension panel of said second carton; and said step of securing said second extension panel of said second carton over and to said first extension panel of said first carton includes the step of securing said last mentioned panels such that said second extension panel of said second carton lies above and is coextensive with said first extension panel of said first carton so that said first and second cartons, when so joined, resemble a single unit.

23. The method of claim 18 further including the step of positioning a carrier means bearing adhesive across a pair of adjacent coplanar walls of said first and second cartons.

24. The method of claim 18 further including the step of wrapping a band of material around said first and second cartons.

25. The method of claim 24 further including the step of providing indicia coded for the automatic pricing of said dual carton on said band of material.

26. The method of claim 18 wherein:

said first and second cartons each comprise a cigarette carton for packaging a first number of cigarette packs in each said carton, each said pack having a pair of front and rear long walls and a pair of opposed short walls;

the widths of said first and second walls of said first and second cartons are at least as wide as a second number of times the width of the long wall of said cigarette pack; and the widths of said third and fourth walls of said first and second cartons are at least as wide as a third number of times the width of the short wall of said cigarette pack; said method further comprising the steps of:

positioning said first number of cigarette packs, equal to the product of said second number of times the width of the long wall of said cigarette pack and said third number of times the width of the short wall of said cigarette pack, inside each of said first and second cartons with said short walls of said packs parallel said third and fourth walls of said cartons, such that said dual carton contains twice said first number of cigarette packs and has dimensions compatible with commercially available tax-stamping equipment; and securing said extension panels of said first and second cartons together to seal said dual carton so that said dual carton may be shipped to a distributor.

27. The method of claim 26 further including the steps of:

applying adhesive on the second extension panel of the other of said first and second cartons on the side of said panel which faces said carton when said panel is folded toward said second wall, for joining said extension panels of said first and second cartons to one another; wherein said adhesive applied to said first wall of one of said first and second cartons and said adhesive applied to said second extension panel of the other of said first and second cartons remains tacky after said first and second cartons are separated so that said adhesive is reusable to reseal said first and second cartons; and passing said dual carton through a commercially available tax-stamping machine.

28. The method of claim 27 further including the step of securing said extension panels of said first and second together to form a dual carton for sale to a consumer.

29. The method of claim 27 further including the steps of:

separating said first and second cartons;

folding said first extension panel of said first carton perpendicular to said first wall and toward said second wall of said first carton;

folding said second extension panel of said first carton perpendicular to said first extension panel of said first carton and toward said second end;

folding said first extension panel of said second carton perpendicular to said first wall of said second carton and toward said second wall of said second carton; and folding said second extension panel of said second carton perpendicular to said first extension panel of said second carton and toward said second end.

30. The method of claim 29 further including the step of securing said second extension panel of said one of said first and second cartons to said second wall of said carton.

31. The method of claim 29 further including the step of tucking said second extension panel of the other of said first and second cartons between said second wall and said cigarette packs.

* * * * *